US006702262B2

(12) United States Patent
Nonaka

(10) Patent No.: US 6,702,262 B2
(45) Date of Patent: Mar. 9, 2004

(54) FUEL SYSTEM OF CARBURETOR

(75) Inventor: Takumi Nonaka, Iwate-ken (JP)

(73) Assignee: Zama Japan (JP)

( * ) Notice: Subject to any disclaimer, the term of this patent is extended or adjusted under 35 U.S.C. 154(b) by 0 days.

(21) Appl. No.: 10/099,560

(22) Filed: Mar. 14, 2002

(65) Prior Publication Data

US 2003/0173686 A1 Sep. 18, 2003

(30) Foreign Application Priority Data

Mar. 15, 2001 (JP) ..... 2001-073766

(51) Int. Cl.[7] ..... F02M 19/04

(52) U.S. Cl. ..... 261/50.2; 261/51; 261/63; 261/121.3; 261/121.4; 261/DIG. 1; 261/DIG. 38

(58) Field of Search ..... 261/35, 50.1, 50.2, 261/51, 60, 63, 121.3, 121.4, DIG. 1, DIG. 38

(56) References Cited

U.S. PATENT DOCUMENTS

| | | | | | |
|---|---|---|---|---|---|
| 2,014,763 | A | * | 9/1935 | Grace | 261/121.3 |
| 2,656,166 | A | * | 10/1953 | Foster | 261/121.3 |
| 3,013,779 | A | * | 12/1961 | Kalert, Jr. et al. | 261/51 |
| 3,361,416 | A | * | 1/1968 | Morgan et al. | 261/121.3 |
| 3,640,512 | A | * | 2/1972 | Morgenroth | 261/121.4 |
| 3,680,846 | A | * | 8/1972 | Bickhaus et al. | 261/51 |
| 3,684,257 | A | * | 8/1972 | Lawrence | 261/121.3 |
| 3,693,947 | A | * | 9/1972 | Masaki et al. | 261/121.3 |
| 3,753,555 | A | * | 8/1973 | Lawrence | 261/121.4 |
| 3,780,996 | A | * | 12/1973 | Nutten | 261/121.3 |
| 3,880,962 | A | * | 4/1975 | Rhodes et al. | 261/121.4 |
| 4,136,139 | A | * | 1/1979 | Nakamura et al. | 261/121.4 |
| 4,229,384 | A | * | 10/1980 | Karino et al. | 261/121.3 |
| 4,250,856 | A | * | 2/1981 | Abbey | 261/121.3 |
| 4,289,715 | A | * | 9/1981 | Ito et al. | 261/121.3 |
| 4,302,404 | A | * | 11/1981 | Nakamura et al. | 261/DIG. 38 |
| 4,377,141 | A | * | 3/1983 | Karino et al. | 261/121.3 |
| 4,476,067 | A | * | 10/1984 | Katou et al. | 261/121.4 |
| 4,506,644 | A | * | 3/1985 | Katou et al. | 261/121.4 |
| 4,545,350 | A | * | 10/1985 | Nakamura et al. | 261/121.4 |

FOREIGN PATENT DOCUMENTS

| | | |
|---|---|---|
| JP | 46-10565 | 3/1971 |
| JP | 49-17682 | 5/1974 |

* cited by examiner

*Primary Examiner*—Richard L. Chiesa
(74) *Attorney, Agent, or Firm*—Orrick, Herrington & Sutcliffe LLP

(57) ABSTRACT

The present invention facilitates the stabilization of the fuel flow rate in a single fuel system carburetor in which bleed air, mixed with fuel, is controlled by a metering needle moving in response to the movement of a throttle valve and the mixture is discharged into an intake channel. The present invention is directed to a carburetor in which an effective surface area of a metering hole is adjusted by a metering needle moving in response to the movement of a throttle valve, and the fuel introduced into a mixing chamber from a constant-fuel chamber under flow rate control with a metering hole is mixed with bleed air and discharged into an intake channel from a nozzle orifice. The mixing chamber has a volume providing for absorption and relaxation of changes in the negative pressure acting upon the nozzle orifice, the fuel is sucked in under stabilized negative pressure, and the air-fuel mixture with a preset air/fuel ratio is supplied over the entire operation range of the engine.

7 Claims, 4 Drawing Sheets

FUEL SYSTEM OF CARBURETOR

FIELD OF THE INVENTION

The present invention relates to a fuel system provided in a carburetor for general purpose engines and, more particularly, to fuel systems designed so that the flow rate of a fuel supplied from a constant-fuel chamber to a nozzle orifice is mechanically adjusted in response to the open-close operation of a throttle valve, and the fuel is mixed with bleed air and discharged into an intake channel.

BACKGROUND OF THE INVENTION

Because carburetors supplying fuel to general purpose engines are small, they mostly have simplified fuel systems. Well-known carburetors include fixed venturi carburetors using a single fuel system in which a nozzle orifice is opened in the narrowest portion of venturi tube, as described in Japanese Patent Application No. 46-10565, and variable venturi carburetors using a single fuel system in which a nozzle orifice is opened in a variable venturi tube of a slide throttle valve type disclosed in Utility Model Application No. 49-17682.

The advantage of using a single fuel system is that a fuel flow rate smoothly transitions from a low-speed operation range to an intermediate or high-speed operation range. Furthermore, the advantage of adding a mechanism for mechanically adjusting the fuel flow rate in response to the open-close operation of a throttle valve to such a system is that the air/fuel ratio is maintained within a preset range corresponding to the fuel flow rate and the air flow rate. Moreover, the introduction of bleed air is advantageous because it optimizes the fuel flow rate and improves formation of fine droplets of fuel discharged into the intake channel.

A mechanism for adjusting the fuel flow rate includes inserting a metering needle into a fuel nozzle adjusting the effective surface area and also represents the conventional technology. Moreover, in such a structure, bleed air is introduced between the main jet of a fuel passage and a nozzle orifice, and the flow rate of bleed air introduced into the fuel passage is determined by the difference in pressure between the bleed air inlet opening and nozzle orifice.

However, when the intake negative pressure generated during idling of general purpose engines was continuously measured, it was found that the intake negative pressure was not constant and was changing cyclically. Negative pressure acting in the nozzle orifice changes under the effect of these changes in the intake negative pressure. As a result, the difference in pressure between the nozzle orifice and bleed air inlet opening and the difference in pressure between the nozzle orifice and constant-fuel chamber also change, disturbing the air/fuel ratio in the air-fuel mixture supplied to the engine and, thus, destabilizing idling. Destabilization of idling causes cyclic degradation because it increases variations of the intake negative pressure and further destabilizes idling.

In engines for general applications, the quantity of discharge gases is small and the required fuel flow rate is low. Therefore, the effect produced by changes in the fuel flow rate during idling cannot be ignored.

SUMMARY OF THE INVENTION

The fuel system of the present invention was developed in particular to resolve the above-described problem of engine destabilization caused by changes in the intake negative pressure occurring during idling. It is an object of the present invention to equip a carburetor with a fuel system providing stable operation of the engine by constantly supplying thereto an air-fuel mixture with an air/fuel ratio within a preset range.

In order to resolve the above-described problems, a fuel system of the present invention comprises a single fuel passage leading from a constant-fuel chamber to a nozzle orifice opened into an intake channel, wherein a fuel adjusting part and a mixing chamber are provided in the fuel passage. The fuel adjusting part adjusts the effective surface area for passing the fuel with a metering needle executing linear reciprocal movement in response to the open-close operation of a throttle valve. Bleed air and the fuel that passed through the fuel adjusting part are introduced into the mixing chamber, which has a volume sufficient to absorb and cause a relaxation of changes of the negative pressure acting in the nozzle orifice. A mixture of the fuel and bleed air produced in the mixing chamber discharges from the nozzle orifice into the intake channel.

Controlling the fuel flow rate in a single fuel system by using a metering needle moving in response to the open-close operation of a throttle valve makes it possible to smoothly change the fuel flow rate over the entire operation range of the engine and to maintain the air/fuel ratio within the preset range by establishing correspondence with the flow rate of the engine intake air. Furthermore, since the flow rate of bleed air and fuel is determined by the difference in pressure between the bleed air inlet opening and the constant-fuel chamber or mixing chamber, the bleed air and fuel are suction introduced into the mixing chamber by the stabilized negative pressure, which is practically unaffected by the variations of the intake negative pressure, and the air/fuel ratio is maintained in even more appropriate preset range, thereby providing for stable operation of the engine.

Further, objects and advantages of the invention will become apparent from the following detailed description and accompanying drawings.

DETAILED DESCRIPTION OF THE PREFERRED EMBODIMENTS

Figure 1:
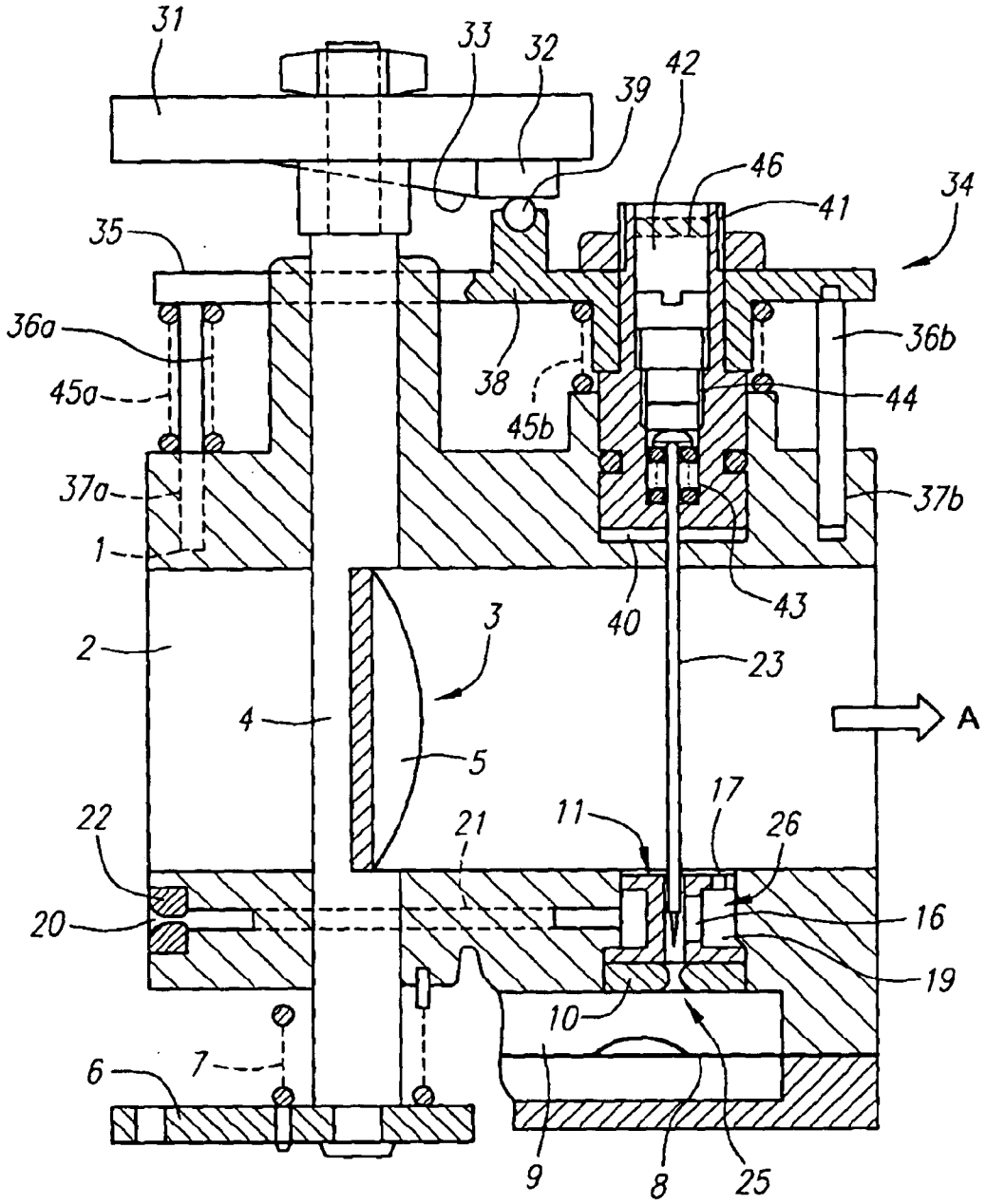
FIG. 1 is a longitudinal section illustrating a first embodiment of a carburetor of the present invention.

The preferred embodiment of the present invention will be described below with reference to the drawings. FIG. 1 is a schematic view of almost the entire carburetor. An intake channel 2 having the same diameter along the entire length thereof is formed through a body 1. A conventional butterfly throttle valve 3 is provided so that both ends of a valve shaft 4 protrude from the body 1. The throttle valve 3 comprises a round valve plate 5 attached to the valve shaft 4 rotatably retained in the body 1 and crossing the intake channel 2. Air from an air cleaner (not shown in the figure) passes through the throttle valve 3, flows in the direction of arrow A, and is sucked into the combustion chamber of an engine (not shown in the figures).

Furthermore, opening and closing of the throttle valve 3 is conducted by a well-known conventional method, for example, by tension rotating a throttle valve lever 6 secured to one end of the valve shaft 4 by an acceleration operation, or by an elastic force of a return spring 7 consisting of a helical coil spring installed at the same end of the shaft and actuated by the throttle valve lever 6. In this embodiment, the intake channel 2 has the same diameter along the entire length thereof and contains no fixed or variable venturi tube. Therefore, the required air flow rate during high output can be readily ascertained.

A constant-fuel chamber 9 covered with a diaphragm 8 is provided on the surface of body 1 at the side thereof where the throttle valve lever 6 is disposed. Fuel from a fuel tank (not shown in the figure) is introduced into the constant-fuel chamber 9 by a fuel pump (not shown in the figures), typically a conventional oscillation-type diaphragm fuel pump operating based on the pressure oscillations generated in a crank chamber of the engine, provided along one surface of the body 1. Additionally, the quantity of fuel introduced by a fuel valve (not shown in the figures) which is opened and closed in response to displacement of the diaphragm 8, is controlled and a constant quantity of fuel is maintained in the constant-fuel chamber 9, which is also within the framework of the conventional technology.

Figure 2A:
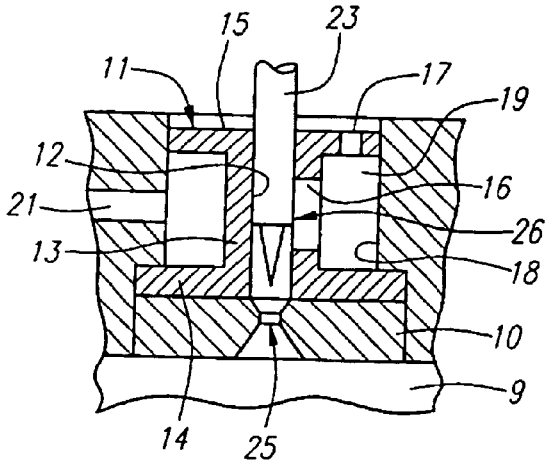
FIG. 2(A) is an enlarged partial section view of the carburetor of FIG. 1.

A main jet 10 establishing the maximum flow rate of fuel and a fuel nozzle 11 are disposed adjacent to each other in the portion of the body 1 between the intake channel 2 and the constant-fuel chamber 9. As shown in FIG. 1 and FIGS. 2(A) and (B), the fuel nozzle 11 has a push flange 14 located on a base end of a tube 13 having a through hole 12 connected to a jet hole of the main jet 10, and also has a discharge flange 15 adjacent to the intake channel 2 at the front end thereof. A long metering hole 16 extending in the direction of the central axis is provided in the wall of the tube 13, and a nozzle orifice 17 consisting of a plurality of small holes is provided in the discharge flange 15.

The main jet 10 and the fuel nozzle 11 are linked to the intake channel 2 and the constant-fuel chamber 9. The main jet 10 and the push flange 14 are fitted into a large-diameter portion (at the side of the constant-fuel chamber 9) of a stepped retaining hole 18 provided in the body 1. The tube 13 and the discharge flange 15 are fitted and secured in a small-diameter portion of the hole 18 at the side of the intake channel 2. The space of the small-diameter portion sandwiched between the two flanges 14 and 15 forms a ring-like mixing chamber 19 surrounding the tube 13. The intake channel 2 and the mixing chamber 19 are air-tight insulated by the discharge flange 15. In addition, a bleed air passage 21 with a bleed air inlet opening 20 opened at the end surface of the body 1 at the air cleaner side thereof is connected to the mixing chamber 19. The passage 21 includes a bleed air jet 22 controlling the bleed air flow rate.

The above-described main jet 10 and fuel nozzle 11 are disposed downstream of the throttle valve 3. A front end portion of a metering needle 23 disposed parallel to the valve shaft 4 and across the intake passage 2 is inserted into the through hole 12. The metering needle 23 executes linear reciprocal motion in response to the open-close operation of the throttle valve 3 so that the metering hole 16 has a minimum aperture during idling of the engine and a maximum aperture during maximum output. The flow rate of fuel into the mixing chamber 19, which was introduced from the constant-fuel chamber 9 via the main jet 10 into the through hole 12, is controlled by adjusting the effective surface area of the metering hole 16. The metering hole 16 and the metering needle 23 constitute a fuel adjusting part 26 provided in a fuel channel 25 composed of the main jet 10, the through hole 12, the metering hole 16, the nozzle orifice 17, and the mixing chamber 19.

Fuel introduced into the mixing chamber 19 is mixed with bleed air introduced into the mixing chamber 19 through the bleed air passage 21 and the mixture is discharged from the nozzle orifice 17 into the intake channel 2. In the present embodiment, the discharge flange 15 provided with the nozzle orifice 17 is almost flush with the wall surface of the intake channel 2. Therefore, the introduction of bleed air improves the formation of fine droplets of fuel and effectively eliminates a wall surface flow of the fuel.

Changes in the negative pressure acting upon the nozzle orifice 17 because of changes in the intake negative pressure generated in the engine, especially in an idling mode, directly act upon the bleed air passage 21, the through hole 12, and the main jet 10. The flow rates of bleed air and fuel change accordingly, causing changes in the air/fuel ratio in the air-fuel mixture supplied to the engine. The mixing chamber 19 is provided to prevent this effect. For this purpose, the mixing chamber 19 is provided with a volume such that the chamber has a buffer function of absorbing, relaxing and smoothing the changes of the negative pressure acting upon the nozzle orifice 17. The negative pressure in the mixing chamber 19 is a pressure acting upon the bleed air inlet opening 20, typically a value between atmospheric pressure and the negative value acting upon the nozzle orifice 17. The bleed air flow rate is determined by the difference in pressure between the bleed air inlet opening 20 and the mixing chamber 19.

The preset quantity of fuel controlled by the fuel adjusting part 26 is introduced into the mixing chamber 19 in which the stabilized negative pressure is maintained, and the air-fuel mixture having the air/fuel ratio maintained within an appropriate preset range is supplied into the engine. Furthermore, the increase in fuel flow rate by a high intake negative pressure acting upon the metering hole 16, in particular, during idling is eliminated. Because of the combined utilization of the metering needle 23 and the mixing chamber 19, the fuel flow rate is smoothly changed over the entire operation range of the engine, the required fuel flow rate in each operation mode can be supplied appropriately and with good stability, and the engine can be operated with good stability.

In addition, a disk-like cam part 31 is fixedly mounted onto the other end of the valve shaft 4. This cam part 31 is in the form of an arc having the valve shaft 4 as a center and has a cam 32 with a cam surface 33 facing the body 1.

A flat driven part 35 is arranged along the surface of the body 1 where the cam part 31 is disposed. Feet 36A and 36B protruding from ends of the driven part 35 are inserted into receiving holes 37A and 37B provided in the body 1. A ball is rotatably supported at a front end of a stand 38 protruding from the central zone of the driven part 35. The ball forms a contact part 39 which is in contact with the cam surface 33.

In the portion between the stand 38 of the driven part 35 and the foot 36B, a cylindrical retaining part 41 having an operation hole 42, which is open at the base end, is fit and secured in the body 1. The front end of the retaining part 41 is slidably and air-tightly inserted into a retaining hole 40 provided in the body 1. A metering needle 23 crossing the inlet channel 2 is inserted from the front end of the retaining part 41 into the operation hole 42, and a spring 43 provides a force biasing the needle in the direction of deep insertion into the hole. The metering needle 23 is retained in the preset position in the retaining part 41 because the front end of an adjustment screw 44 inserted and screwed into the operation hole 42 from the base end side is in contact with the base end of the metering needle 23.

The driven part 35 having the contact portion 39, which is in contact with the cam surface 32, and the retaining part 41 retaining the metering needle 23 constitute an actuator 34 causing the metering needle 23 to move linearly and reciprocally following the angular reciprocal movement of the cam part 31. The feet 36A and 36B and the receiving holes 37A and 37B act as rotation stoppers providing for stable linear reciprocal movement of the retaining part 41 along the central axis identical to that of the fuel nozzle 11 and the metering needle 23 so that the driven part 35 is not displaced by the angular reciprocal movement of the cam part 31. Furthermore, push springs 45A and 45B composed of compressed coil springs are sandwiched between the body 1 and the driven part 35 around one foot 36A and the retaining part 41, respectively, which are located on both sides of the contact part 39. The push springs 45A and 45B apply pressure to the contact part 39 so that it is constantly in contact with the cam surface 32. At the same time, they provide for parallel, tilt-free movement of actuator 34, resulting in accurate metering of fuel flow rate by the metering needle 23.

In the above-described preferred embodiment, upon completion of assembly, if necessary, the adjustment screw 44 is rotated to adjust the insertion depth of the metering needle 23 into the through hole 12, especially, during idling, that is, to adjust the effective opening surface area of metering hole 16, thereby providing for stable idling. As shown in FIG. 1, since the retaining part 41 is disposed in the region outside of the cam part 31, adjustment can be conducted in an easy manner. Furthermore, once the adjustment has been completed, a plug 46 is inserted under pressure into the base end of the operation hole 42 and seals it. As a result, mistuning of engine operation by the engine user moving the metering needle 23 can be prevented.

In an idling mode, the contact part 39 is in contact with the highest portion of cam surface 33, the effective opening surface area of the metering hole 16 controlled by the metering needle 23 is minimum. Therefore, if opening of the throttle valve 3 is initiated, the contact part 39 is brought in contact with gradually lowering portions of the cam surface 33 and the effective opening surface area of the metering hole 16 is increased. When the throttle valve 3 is fully opened, the metering hole 16 is fully opened. Thus, according to this embodiment, the flow rate characteristic of fuel can be set at random by changing the shape of the cam 32, the shape of the front portion of metering needle 23, and the size and shape of metering hole 16.

In the present embodiment, the intake channel 2 had a uniform diameter along the entire length and comprised no fixed or variable venturi tube. As a result, the required air flow rate during high output can be readily ascertained. However, the fuel system in accordance with the present invention can be used not only in such carburetor, but it is also suitable, without any changes, for a carburetor with a sliding throttle valve. In such case, the fuel nozzle 11 is disposed so as to face the sliding throttle valve, and the metering needle 23 is supported by the sliding throttle valve and reciprocally moves along a line integrally therewith.

FIGS. 3 to 6 illustrate various embodiments of a fuel system 25. In the fuel system shown in FIGS. 3(A) and (B), a nozzle orifice 17A is formed by providing a plurality of notches on the outer peripheral edge of the discharge flange 15. In the fuel system shown in FIGS. 4(A) and (B), a nozzle orifice 17B is obtained by forming the discharge flange 15 of a slightly decreased diameter and providing a narrow ring-like gap between it and the wall of the retaining hole 18. In the fuel system shown in FIGS. 5(A) and (B), the discharge flange 15 of the fuel nozzle 11 is eliminated and a nozzle orifice 17C is obtained by forming an inward flange 48 in the end portion of the attachment hole 18 at the side of intake channel 2 and providing a narrow ring-like gap between it and the front end of the tube 13. In the fuel system shown in FIGS. 6(A) and (B), the discharge flange 15 of the fuel nozzle 11 is eliminated and a nozzle orifice 17D is obtained by introducing a ring-like part 49 in the end portion of the attachment hole 18 at the side of the intake channel 2 and providing a narrow ring-like gap between it and the front end of tube 13.

All of the parts that are not shown in FIGS. 3, 4, 5, and 6 are identical to those of the embodiment illustrated by FIG. 1. Drawings illustrating the through hole 12 of the fuel nozzle in those embodiments are also omitted, but the metering needle 23 is inserted from the intake channel and together with the metering hole 16 forms the fuel adjusting part 26.

Figure 7:
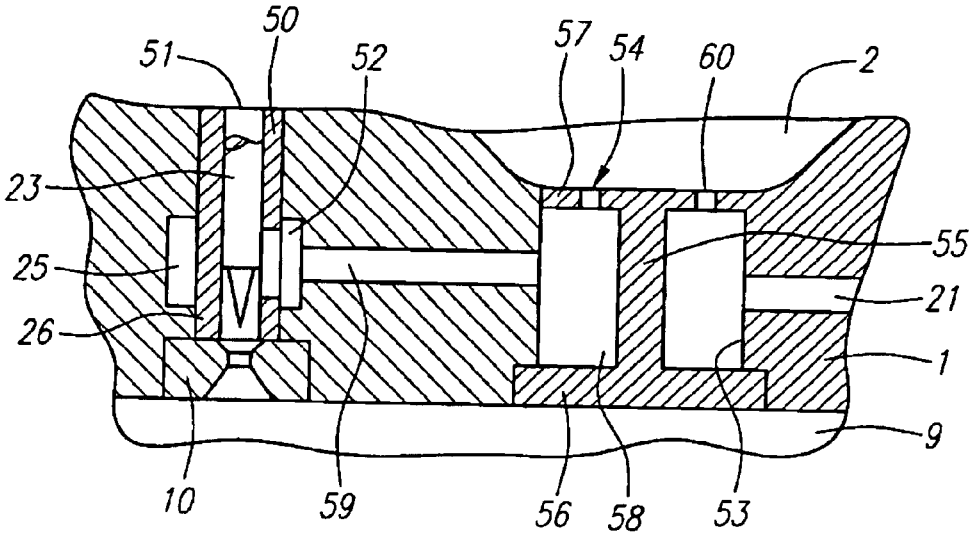
FIG. 7 is an enlarged partial section view illustrating a sixth embodiment of the present invention.
Figure 8:
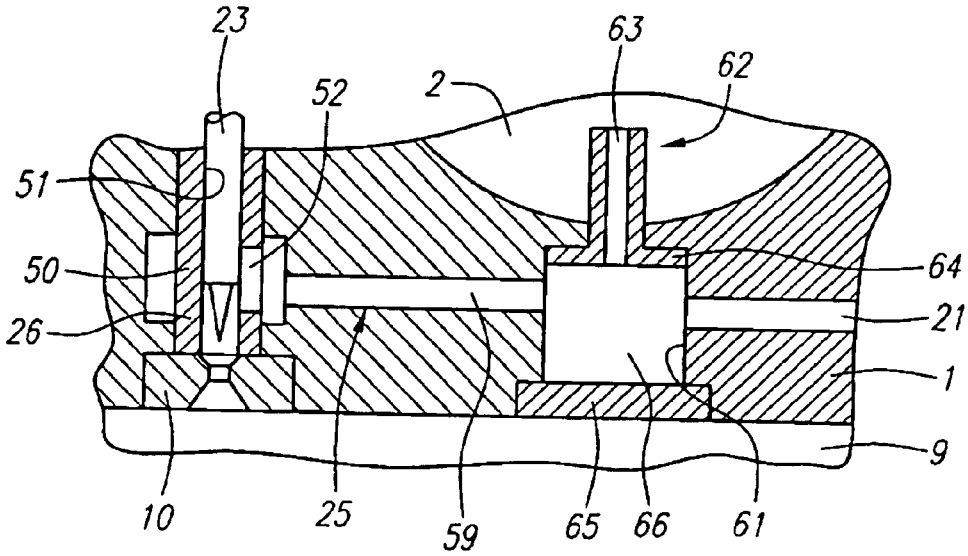
FIG. 8 is an enlarged partial section view illustrating a seventh embodiment of the present invention.

FIGS. 7 and 8 illustrate yet other embodiments of the fuel system 25, in which the metering needle 23 does not cross the intake channel 2 and is disposed at a side thereof. The front end of metering needle 23 is introduced into a through hole 51 of metering tube 50 fit and secured in the body 1 so as to be placed on the main jet 10 adjacent to the constant-fuel chamber 9. A metering hole 52 extended in the direction of the central axis is provided in the wall of the metering tube 50. The effective opening surface area of the metering hole 52 is adjusted so as to be at a minimum during idling of the engine and to be at a maximum when the output is the highest. This adjustment is conducted by the metering needle executing linear reciprocal motion in response to the open-close operation of a throttle valve (not shown in the figures). This portion of the fuel system constitutes the fuel adjusting part 26.

In the embodiment shown in FIG. 7, a stepped retaining hole 53 is provided in the body 1 so as to link the intake channel 2 and the constant-fuel chamber 9. A nozzle body 54, provided on both ends of the shaft 55 with a closing flange 56 and a discharge flange 57, is fixed by fitting the closing flange 56 into a large-diameter portion of the retaining hole 53 at the side of the constant-fuel chamber 9 and by fitting the shaft 55 and the discharge flange 57 into the small-diameter portion of the retaining hole 53 at the side of the intake channel 2. The space of the small-diameter portion sandwiched between the two flanges 56 and 57 forms a mixing chamber 58 possessing the same functions as the mixing chamber 19 in the embodiment illustrated by FIG. 1 and FIG. 2(A). The mixing chamber 58 is connected to the metering hole 52 with a fuel passage 59. Furthermore, the bleed air passage 21 is connected to the mixing chamber 58. The discharge flange 57 air-tightly isolates the mixing chamber 58 from the intake channel 2 and has a nozzle orifice consisting of a plurality of small holes 60. The nozzle orifice 60 can also be in the form of a notch or ring-like gap identical to those shown in FIG. 3 and FIG. 4.

In the embodiment shown in FIG. 8, a three-step stepped retaining hole 61 is provided in the body 1 so as to link the intake channel 2 with the constant-fuel chamber 9. A tubular nozzle body 62 provided with a retaining flange 64 at a base end and having a front end opening as a nozzle orifice 63 is fixed by fitting the retaining flange 64 into the deep end of the intermediate-diameter portion, air-tightly inserting the tubular portion into the small-diameter portion and causing it to protrude into the intake channel 2. A closing part 65 is fixedly mounted in the large-diameter portion at the side of the constant-fuel chamber 9 to air-tightly isolate the constant-fuel chamber 9 and intermediate-diameter portion of the retaining hole 61.

Figure 2B:
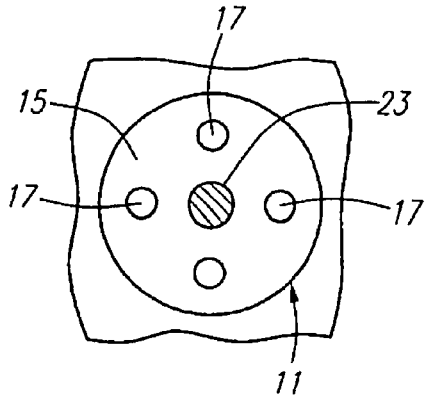
FIG. 2(B) is a plan view of the components shown in FIG. 2(A).
Figure 3A:
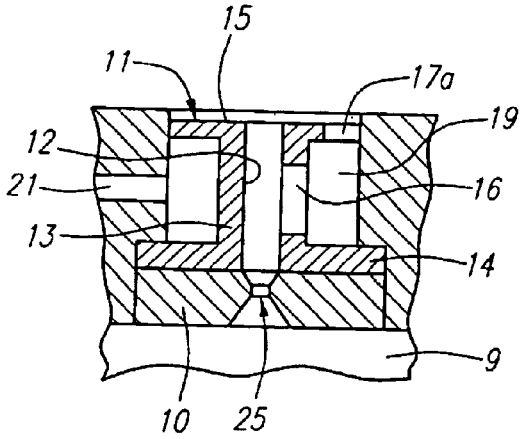
FIG. 3(A) is an enlarged partial section view illustrating a second embodiment of the present invention.
Figure 3B:
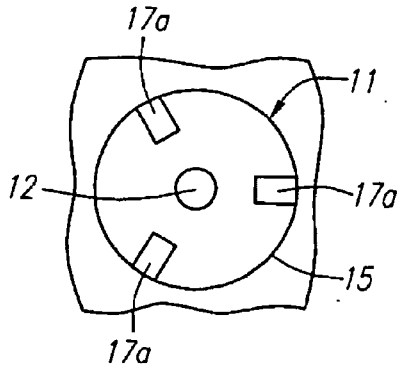
FIG. 3(B) is a plan view of the components shown in FIG. 3(A).
Figure 4A:
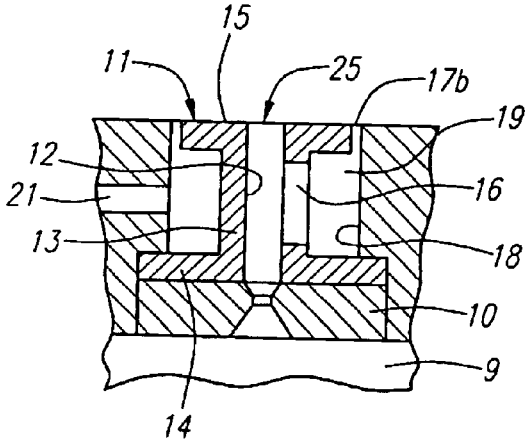
FIG. 4(A) is an enlarged partial section view illustrating a third embodiment of the present invention.
Figure 4B:
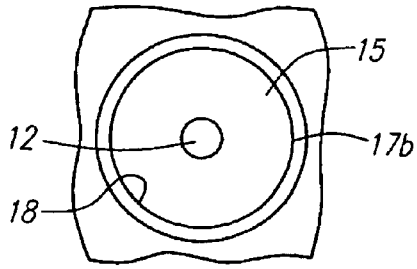
FIG. 4(B) is a plan view of the components of FIG. 4(A).
Figure 5A:
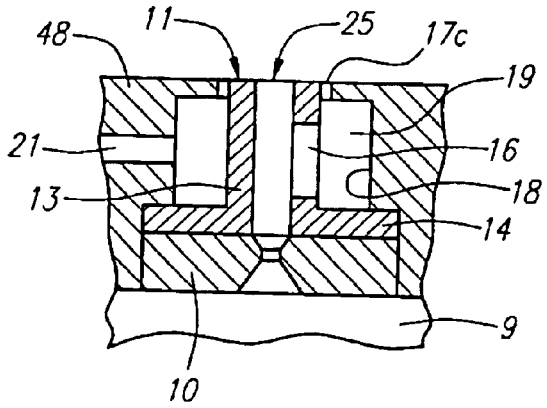
FIG. 5(A) is an enlarged partial section view illustrating a fourth embodiment of the present invention.
Figure 5B:
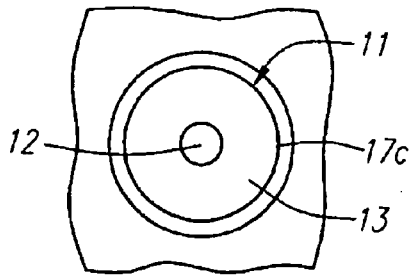
FIG. 5(B) is a plan view of the components of FIG. 5(A).
Figure 6A:
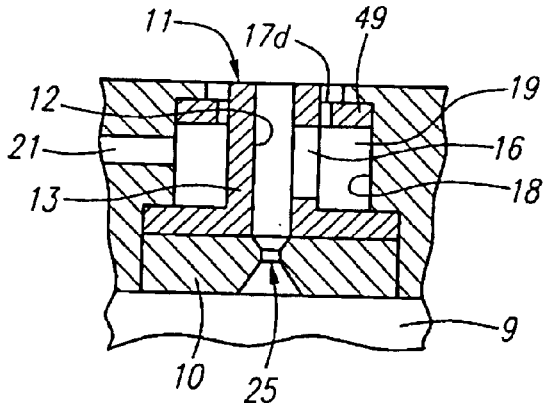
FIG. 6(A) is an enlarged partial section view illustrating a fifth embodiment of the present invention.
Figure 6B:
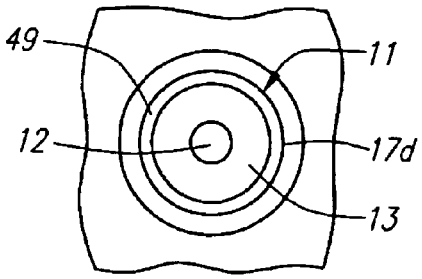
FIG. 6(B) is a plan view of components of FIG. 6(A).

The space of the intermediate-diameter portion of the attachment hole 61 forms a mixing chamber 66 possessing the same functions as the mixing chamber 19 in the embodiment illustrated by FIG. 1 and FIG. 2. The mixing chamber 66 is connected to the metering hole 52 with a fuel passage 59. Furthermore, the bleed air passage 21 is connected to the mixing chamber 66.

In the embodiment illustrated by FIG. 7 and FIG. 8, the mixing chambers 58 and 66 maintain a stable negative pressure so that it is not affected by changes in the negative pressure acting upon the nozzle orifices 60 and 63. Furthermore, since this negative pressure is less than the negative pressure acting upon the nozzle orifices 60 and 63, the fuel controlled in response to the open-close operation of the throttle valve by the fuel adjusting part 26 is sucked into the mixing chambers 58 and 66, the required fuel flow rate is supplied in an appropriate manner and with high stability over the entire operation range of the engine and the engine operation can be stabilized.

In addition, the advantage of the embodiments illustrated by FIG. 7 and FIG. 8 is that the metering needle 23 does not cross the intake channel 2. Therefore, the resistance to the intake air flow can be reduced accordingly and even higher engine output can be obtained. An especially high resistance reduction effect is obtained when the nozzle orifice 60 does not protrude into the intake channel, as in the system shown in FIG. 7.

As described above, in accordance with the present invention, bleed air and fuel are sucked and introduced into a mixing chamber in which a negative pressure is maintained so as to be practically unaffected by changes of the intake negative pressure, and, especially during idling, the air/fuel ratio is maintained within a preset range, and the engine operation can be stabilized.

While various preferred embodiments of the invention have been shown for purposes of illustration, it will be understood that those skilled in the art may make modifications thereof without departing from the true scope of the invention as set forth in the appended claims including equivalents thereof.

What is claimed is:

1. A fuel system of a carburetor, comprising a single fuel passage leading from a constant-fuel chamber to a nozzle orifice opened into an intake channel, wherein a fuel adjusting part and a mixing chamber are provided in said fuel passage, said fuel adjusting part adjusts the effective surface area for passing the fuel with a metering needle executing linear reciprocal movement in response to the open-close operation of a throttle valve, any bleed air and fuel passing through said fuel adjusting part are introduced into said mixing chamber which has a volume sufficient to absorb and cause the relaxation of changes of the negative pressure acting on said nozzle orifice, a mixture of fuel and bleed air produced in said mixing chamber is discharged from said nozzle orifice into said intake channel, wherein a fuel nozzle provided with a metering hole in a wall of a tube having a through hole linked to said constant-fuel chamber and a discharge flange is fitted and disposed in a retaining hole by positioning said discharge flange in almost the same plane with the surface of said intake channel, said metering needle extends in the direction crossing said intake channel inside therein, penetrates into said through hole and forms said fuel adjusting part together with said metering hole, said mixing chamber is provided around said tube, and said nozzle orifice is formed by a small hole provided in said discharge flange.

2. The fuel system of a carburetor as described in claim 1, wherein said intake channel has an almost uniform diameter along the entire length and said nozzle orifice is open into said intake channel downstream of said throttle valve.

3. A fuel system of a carburetor, comprising a nozzle orifice opened into an intake channel, a fuel passage leading from a constant-fuel chamber to the nozzle orifice, a fuel adjusting part provided in the fuel passage, wherein the fuel adjusting part comprises a metering needle linearly and reciprocally movable in response to the open-close operation of a throttle valve, a mixing chamber provided in the fuel passage to receive bleed air and fuel that passed through said fuel adjusting part, and a fuel nozzle provided in the fuel passage, the fuel nozzle comprising a metering hole in a wall of a tube having a through hole linked to the constant-fuel chamber and a discharge flange fitted and disposed in a retaining hole by positioning the discharge flange in almost the same plane with the surface of said intake channel, the metering needle extends across the intake channel and generates into the through hole and forms the fuel adjusting part together with the metering hole, the mixing chamber is provided around the tube, and the nozzle orifice is formed by a small aperture provided in said discharge flange.

4. The fuel system of claim 3, wherein the intake channel has an almost uniform diameter along the entire length and the nozzle orifice is open into the intake channel downstream of a throttle valve.

5. The fuel system of claim 3, wherein the mixing chamber has a volume sufficient to absorb and cause the relaxation of changes of the negative pressure acting on said nozzle orifice.

6. The fuel system of claim 3, further comprising a bleed air passage coupled to the mixing chamber.

7. The fuel system of claim 3, wherein the aperture is a hole.

* * * * *